US009856887B2

(12) United States Patent
Klusacek

(10) Patent No.: US 9,856,887 B2
(45) Date of Patent: Jan. 2, 2018

(54) ROTOR OF A SUPERCHARGING DEVICE

(71) Applicant: Bosch Mahle Turbo Systems GmbH & Co. KG, Stuttgart (DE)

(72) Inventor: Michal Klusacek, Prague (CZ)

(73) Assignee: Bosch Mahle Turbo Systems GmbH & Co. KG (DE)

( * ) Notice: Subject to any disclaimer, the term of this patent is extended or adjusted under 35 U.S.C. 154(b) by 267 days.

(21) Appl. No.: 14/677,659

(22) Filed: Apr. 2, 2015

(65) Prior Publication Data

US 2015/0285260 A1 Oct. 8, 2015

(30) Foreign Application Priority Data

Apr. 3, 2014 (DE) ..... 10 2014 206 409

(51) Int. Cl.

| | |
|---|---|
| ***F04D 29/26*** | (2006.01) |
| ***F01D 25/16*** | (2006.01) |
| ***F04D 29/10*** | (2006.01) |
| ***F04D 29/057*** | (2006.01) |
| ***F02B 33/40*** | (2006.01) |
| ***F04D 29/66*** | (2006.01) |

(52) U.S. Cl.

CPC ..... *F04D 29/26* (2013.01); *F01D 25/164* (2013.01); *F02B 33/40* (2013.01); *F04D 29/057* (2013.01); *F04D 29/102* (2013.01); *F04D 29/662* (2013.01); *F05D 2220/40* (2013.01); *F05D 2240/20* (2013.01); *F05D 2240/53* (2013.01); *F05D 2240/54* (2013.01); *F05D 2260/96* (2013.01)

(58) Field of Classification Search

CPC ..... F04D 29/26; F04D 29/185; F04D 29/102; F01D 25/164; F05D 2240/20; F05D 2240/40; Y02T 10/144

See application file for complete search history.

(56) References Cited

U.S. PATENT DOCUMENTS

| | | | | |
|---|---|---|---|---|
| 3,326,453 A | | 6/1967 | Kun | |
| 4,756,673 A | * | 7/1988 | Miyashita | F01D 25/14 417/400 |
| 6,182,361 B1 | * | 2/2001 | Cox | B23K 11/002 29/523 |

(Continued)

FOREIGN PATENT DOCUMENTS

| | | |
|---|---|---|
| DE | 1575700 A1 | 12/1970 |
| DE | 3428327 A1 | 2/1986 |

(Continued)

OTHER PUBLICATIONS

English translation of DE 102008057729.*

(Continued)

*Primary Examiner* — Woody Lee, Jr.
*Assistant Examiner* — Topaz L Elliott
(74) *Attorney, Agent, or Firm* — Fishman Stewart PLLC

(57) ABSTRACT

A rotor for a supercharging device may include an arrangement; the arrangement may include a compressor wheel operatively coupled to a turbine wheel. A cup-shaped bearing bush configured to receive a radial air bearing may be arranged on at least one longitudinal end of the arrangement. The bearing bush may define an interior including at least one hollow space and a plurality of stiffening ribs extending into the at least one hollow space.

19 Claims, 2 Drawing Sheets

(56) References Cited

U.S. PATENT DOCUMENTS

| | | | | |
|---|---|---|---|---|
| 6,457,311 | B2 | 10/2002 | Fledersbacher et al. | |
| 2005/0115345 | A1 * | 6/2005 | Gumpoltsberger ..... | F16H 3/093<br>74/331 |
| 2013/0209267 | A1 | 8/2013 | Klusacek | |

FOREIGN PATENT DOCUMENTS

| | | | | | |
|---|---|---|---|---|---|
| DE | 100 11 419 | C2 | | 1/2002 | |
| DE | 102008048126 | A1 | * | 3/2010 | ..... F01D 25/16 |
| DE | 102008057729 | A1 | | 5/2010 | |
| DE | 102010006716 | A1 | * | 8/2010 | ..... F01D 11/02 |
| DE | 102012202272 | A1 | | 8/2013 | |
| GB | 2064656 | B | * | 6/1983 | ..... F01D 25/22 |

OTHER PUBLICATIONS

English translation of DE 3428327.*
English translation of EP 985837.*
English translation of DE 102010006716.*
English translation of DE 102008048126.*
English abstract for DE-102008057729.
English abstract for DE-3428327.

* cited by examiner

ROTOR OF A SUPERCHARGING DEVICE

CROSS-REFERENCE TO RELATED APPLICATIONS

This application claims priority to German Patent Application No. 10 2014 206 409.0, filed Apr. 3, 2014, the contents of which are hereby incorporated by reference in their entirety.

TECHNICAL FIELD

The present invention relates to the rotor of supercharging device, in particular of an exhaust gas turbocharger. The invention furthermore relates to a supercharging device with such a rotor.

BACKGROUND

From DE 10 2012 202 272 A1 a generic rotor of a supercharging device with at least two parts which are fastened to one another is known, which together enclose a hollow space. The two parts in this case are fastened to one another via subpressure that is present in the hollow space, in particular via a vacuum. The known rotor is supported via bearing bushes which are arranged alongside on the end sides.

From DE 10 2008 057 729 A1 an exhaust gas turbocharger for an internal combustion engine, in particular for a motor vehicle, is known, in which a rotor is supported in a stator. In order to be able to realise a particularly low-friction bearing, a pneumatic radial bearing is pneumatically charged by the rotor during the operation.

From DE 1 575 700 A1 a further gas-lubricated exhaust gas turbocharger is known.

Disadvantageous with known rotors for exhaust gas turbochargers is that these are usually formed by a solid shaft, which is comparatively heavy. If by contrast hollow bearing bushes for a radial air bearing are employed, these are light but also comparatively soft, as a result of which the natural frequency of the rotor in turn is disadvantageously impaired.

SUMMARY

The present invention therefore deals with the problem of stating an improved or at least an alternative embodiment for a rotor of the generic type, which is characterized in particular by an improved rotor natural frequency.

According to the invention, this problem is solved through the subject of the independent claims. Advantageous embodiments are subject of the dependent claims.

The present invention is based on the general idea of reinforcing or stiffening pot-shaped bearing bushes of a rotor each of which is radially air-bearing supported alongside at the ends by means of stiffening ribs, which extend into a hollow space of the respective bearing bush. The rotor according to the invention in this case comprises a compressor wheel and a turbine wheel fastened thereon, and at least on one longitudinal end the previously mentioned pot-shaped bearing bushing for the radial air bearing, wherein this bearing bush has at least one hollow space and multiple stiffening ribs extending into said hollow space. Because of the hollow embodiment of the bearing bush it is light on the one hand, which is advantageous in particular for use in exhaust gas turbochargers in a motor vehicle. On the other hand, the stiffening ribs increase the strength of the pot-shaped bearing bush, as a result of which it has significant improvements with respect to the rotor natural frequency. With the rotor according to the invention a rotor natural frequency can be achieved which is above the rotational speed of the rotor. In order to further increase the rotor natural frequency the weight at the rotor ends can be reduced, by way of which a deformation of the bearing bush through the stiffening is prevented.

Practically a face wall of the bearing bush is reinforced. A face wall thus reinforced again stiffens the bearing bush and contributes towards positively influencing the rotor natural frequency. Reinforcing the face wall in this case can be brought about through a convex bulge.

In an advantageous further development of the solution according to the invention, the stiffening ribs are formed in one piece with the bearing bush so that the bearing bush and the stiffening ribs are produced from one piece, i.e. "one casting". This offers in particular advantages in the production of the bearing bush since no additional assembly of the reinforcing or stiffening ribs is required.

Practically, multiple hollow spaces and multiple stiffening ribs are provided, which are produced through axially parallel bores. The bearing bush is thus originally produced as a solid profile, wherein the hollow spaces and the stiffening ribs delimiting the individual hollow spaces are produced by bores which are subsequently introduced. Here, the bores have to be obviously distributed symmetrically to the axis of the bearing bush so as not to create an unbalance later on during operation, i.e. upon a rotation of the rotor. A bearing bush produced in such a manner is also cost-effectively producible with a high quality. Obviously it is also conceivable that the hollow spaces can be generally produced through erosion processes, as a result of which a cost-effective production of the bearing bushes is likewise realisable.

In a further advantageous embodiment of the solution according to the invention, the compressor wheel and the turbine wheel of the rotor each have a central recess facing one another, wherein between the compressor wheel and the turbine wheel a sealing disc is arranged, which likewise has such a central recess. At the same time, the compressor wheel, the sealing disc and the turbine wheel are screwed together by a central screw, wherein the central recess in the sealing disc and in the compressor wheel are formed for example as passage openings, whereas the recess in the turbine wheel is formed as a screw-in opening. Because of this it is possible to insert a screw connecting the three components to one another from the back of the compressor wheel, i.e. from the bearing bush of the same through the compressor wheel and the sealing disc and screw it into the turbine wheel. This makes possible clamping the three components to one another. Such a screw connection of the rotor offers in particular the major advantage of being able to easily exchange individual components of the same, for example the sealing disc arranged in the middle because of wear.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

There it shows, in each case schematically.

DETAILED DESCRIPTION

Figure 1:
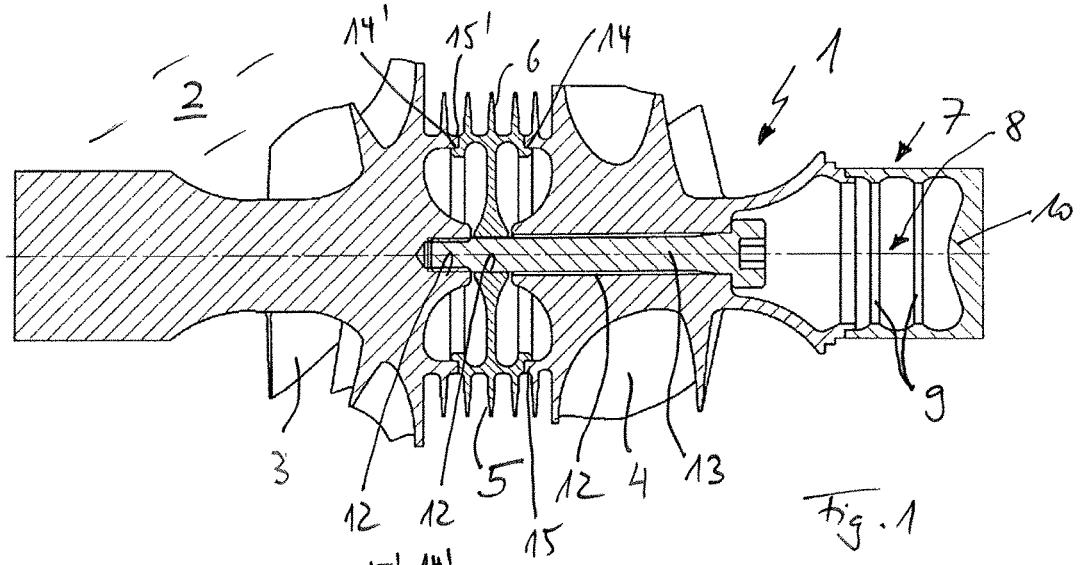
FIG. 1 a sectional representation through a rotor according to the invention with a bearing bush in the region of a turbine wheel, FIG. 2 a representation as in FIG. 1, however with a differently configured bearing bush, FIG. 3 a part sectional representation and a view of a bearing bush according to FIG. 2, FIG. 4 a representation as in FIG. 1, however with bearing bush that can be screwed in, FIG. 5 a bearing bush that can be screwed on in a view.
Figure 2:
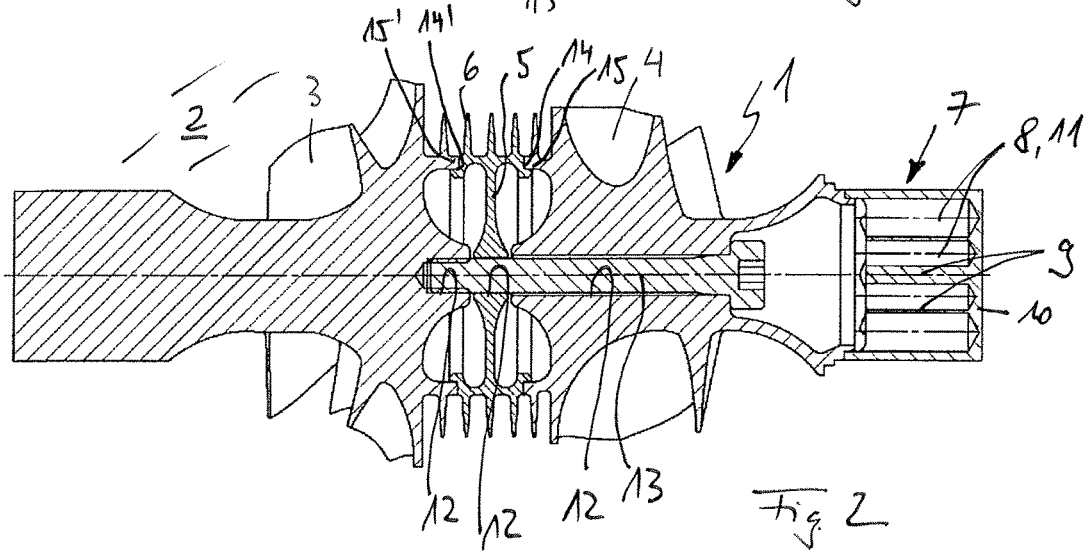
Figure 4:
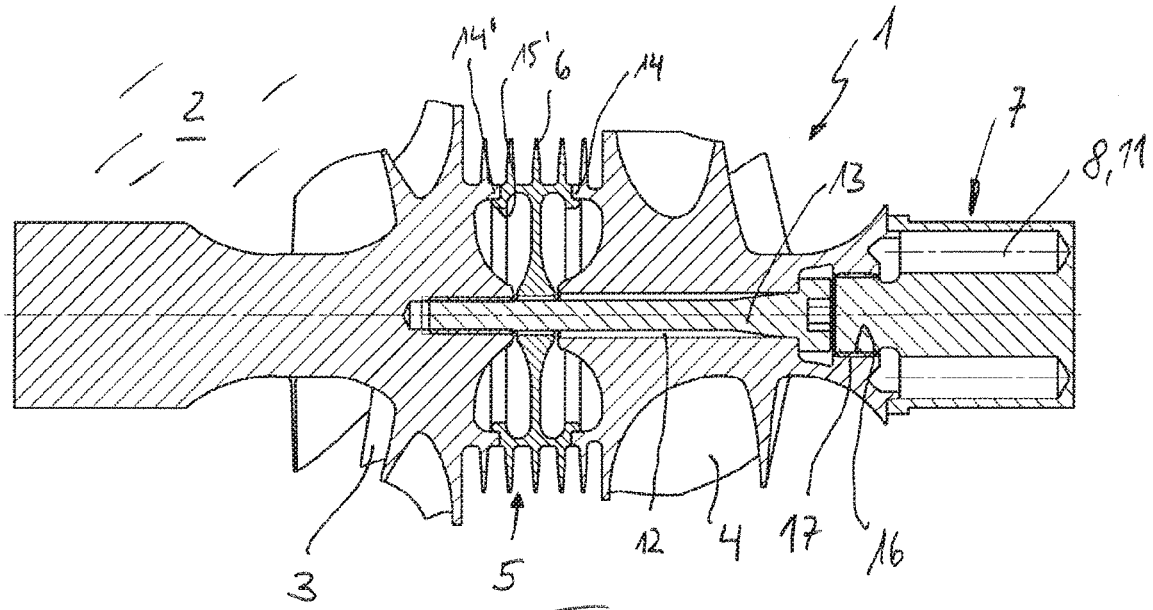

According to the FIGS. 1, 2 and 4, a rotor 1 according to the invention of a supercharging device 2 which is otherwise merely schematically hinted, in particular of an exhaust gas turbocharger, comprises a compressor wheel 3 and a turbine wheel 4 which is indirectly fastened thereon. Between the compressor wheel 3 and the turbine wheel 4 a sealing disc 5 with multiple annular sealing fins or labyrinths 6 is arranged. The sealing disc 5 is preferentially produced from a titanium material, which minimises the heat transfer from the turbine wheel 4 to the compressor wheel 3. On the turbine wheel side a pot-shaped bearing bush 7 for the radial air bearing is provided, which comprises at least one hollow space 8 and multiple stiffening ribs 9 extending into this hollow space. On its face wall 10, the bearing bush 7 can have an axial bearing surface in particular a grooved axial air bearing.

Through the hollow design of the bearing bush 7, the same can be formed comparatively light, i.e. with little weight, which in particular is of special advantage for using the rotor 1 in a supercharging device 2 in a motor vehicle. Because of the additionally provided stiffening ribs 9, the strength of the bearing bush 7, in particular in radial direction, can be significantly increased which likewise has a positive effect on a rotor natural frequency of the rotor 1. In the case of the rotor 1 according to the invention, the rotor natural frequency can be increased via the rotational speed of the rotor 1 so that the same during the operation of the exhaust gas turbocharger is never reached and accordingly no natural frequency problems occur. In order to further increase the rotor natural frequency, the weight at the rotor ends can be reduced, by way of which a deformation of the bearing bush 7 through the stiffening is prevented.

According to the FIGS. 1 and 2, the bearing bush 7 in this case is merely provided on the turbine side, wherein it is obviously also conceivable that such a bearing bush 7 is exclusively provided on the compressor side or on both sides.

Looking at a face wall 10 of the bearing bush 7, it is evident with the bearing bush 7 shown according to FIG. 1 that the same has a convex bulge and is thereby reinforced which likewise has a positive effect on the strength and stiffness of the bearing bush 7. The stiffening ribs 9 shown according to FIG. 1 are annular in design and project towards the interior into the hollow space 8 collar-like. Generally, the bearing bush 7 according to FIG. 1 merely has a single hollow space 8.

Figure 3:
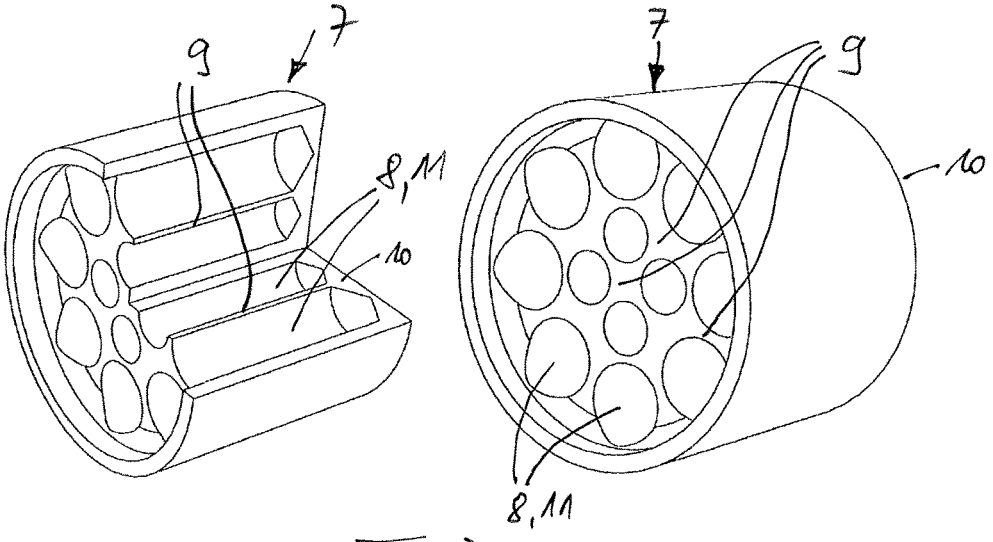

In contrast with the bearing bush 7 according to FIG. 1, the bearing bush 7 according to FIG. 2 comprises multiple hollow spaces 8 and multiple stiffening ribs 9, which are produced through axially parallel bores 11 (see in particular FIG. 3). In addition to producing the hollow spaces 8 by drilling, these can obviously be produced also by erosion processes.

Looking once more at the FIGS. 1 and 2 it is evident that the compressor wheel 3 and the turbine wheel 4 each have a central recess 12 facing one another, just like the sealing disc 5 located between the compressor wheel 3 and the turbine wheel 4. All three components of the rotor 1, i.e. the compressor wheel 3, the turbine wheel 4 and the sealing disc 5 in this case are screwed together, i.e. fastened to one another by a central screw 13. By unscrewing the central screw 13, disassembly of the rotor 1, in particular for example for replacing individual components, such as for example the sealing disc 5, is easily possible. Tightening of the screw 13 in this case is performed from the compressor side, for the purpose of which the bearing bush 7 is removed.

The bearing bush 7 is connected annularly sealingly to the turbine wheel 4, in particular for example welded, soldered, upset or glued. The sealing disc 5 has two annular steps 14 and 14' located opposite, wherein the compressor wheel 3 with an annular edge 15' engages in one of these, whereas the turbine wheel 4 with an annular edge 15 engages in the other annular step 14.

Figure 5:
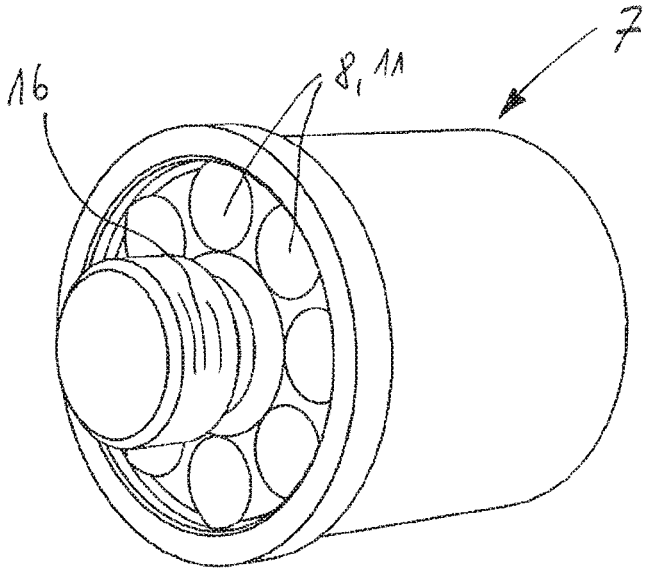

According to FIG. 4 an embodiment is shown in which the bearing bush 7 is screwed to the turbine wheel 4. For this purpose, the bearing bush 7 comprises an external thread 16 and the turbine wheel 4 a complementarily associated internal thread 17 (see also FIG. 5). Accordingly, to disassemble the rotor 1, the bearing bush 7 has to be first unscrewed in order to make possible access to the screw 13. To save weight, the bearing bush 7 shown according to the FIGS. 4 and 5 also has hollow spaces 8.

In a further embodiment, the screw 13 and the bearing bush 7 in FIG. 4 can be formed in one piece so that the three components of the rotor 1, i.e. the compressor wheel 3, the turbine wheel 4 and the sealing disc 5 are screwed to one another by attaching the bearing bush 7, i.e. fastened to one another.

With the rotor 1 according to the invention it is possible to realise a radial air bearing at the rotor 1 with high strength in radial direction. For this purpose, the radial bearing element, i.e. concretely the bearing bush 7 comprises multiple stiffening ribs 9, which engage in at least one hollow space 8 of the bearing bush 7 or delimit multiple of these hollow spaces 8. Because of the stiffening ribs 9, a deformation tendency of the bearing bush 7 in the case of high rotor rotational speed can additionally be reduced. The stiffening ribs 9 likewise have an advantageous effect on the rotor natural frequency of the rotor 1.

With the rotor 1 according to the invention, the rotor natural frequency in particular can be raised above the rotational speed of the rotor 1, so that the same exclusively rotates in a sub-critical range. This is mainly achieved through the bearing located outside and the increased stiffness.

The invention claimed is:

1. A rotor for a supercharging device, comprising: an arrangement defining a rotation axis and including a compressor wheel operatively coupled to a turbine wheel, the arrangement on at least one longitudinal end further including a cup-shaped bearing bush for a radial air bearing, wherein the bearing bush defines an interior including at least one hollow space and a plurality of stiffening ribs extending into the at least one hollow space, and wherein the bearing bush is screwed to at least one of the compressor wheel and the turbine wheel.

2. The rotor according to claim 1, wherein the bearing bush defines an axial face wall having an axial bearing surface, and wherein the axial face wall is reinforced.

3. The rotor according to claim 1, wherein the plurality of stiffening ribs are annular and project into the interior of the bearing bush to define the at least one hollow space.

4. The rotor according to claim 1, wherein the plurality of stiffening ribs delimit a plurality of hollow spaces, wherein the plurality of hollow spaces define a plurality of axially parallel bores.

5. The rotor according to claim 4, wherein the plurality of hollow spaces are disposed symmetrically in the interior of the bearing bush with respect to an axis of rotation of the bearing bush.

6. The rotor according to claim 1, wherein:

the compressor wheel and the turbine wheel each include a central recess facing one another;

the arrangement further includes a sealing disc disposed between the compressor wheel and the turbine wheel, the sealing disc including a central recess arranged coaxially to the central recess of the compressor wheel and the turbine wheel; and the compressor wheel, the sealing disc and the turbine wheel are secured to one another via a central screw arranged in the respective central recesses.

7. The rotor according to claim 6, wherein the bearing bush and the central screw are configured as one piece.

8. The rotor according to claim 6, wherein the sealing disc further includes a plurality of annular sealing fins defining a labyrinth seal.

9. The rotor according to claim 6, wherein the sealing disc further includes a first annular step and a second annular step disposed axially opposite one another with respect to the rotation axis; and wherein the compressor wheel engages the first annular step via a first annular edge and the turbine wheel engages the second annular step via a second annular edge.

10. The rotor according to claim 1, wherein the bearing bush is sealingly connected to and extends annularly about at least one of the compressor wheel and the turbine wheel.

11. The rotor according to claim 1, wherein the bearing bush includes an axial face wall, wherein the axial face wall defines a convex profile defined by a bulge projecting in a direction towards the interior.

12. A supercharging device, comprising:

a rotor defining a rotation axis and including a compressor wheel having a first face end operatively coupled to a turbine wheel having a second face end, the second face end of the turbine wheel facing towards the first face end of the compressor wheel, wherein the rotor includes a first longitudinal end opposite the first face end of the compressor wheel and a second longitudinal end opposite the second face end of the turbine wheel;

at least one bearing bush disposed coaxially to the rotor on at least one of the first longitudinal end and the second longitudinal end, the at least one bearing bush including an axial face wall and a circumferentially extending radial wall defining an interior, the interior of the at least one bearing bush including at least one hollow space and a plurality of stiffening ribs extending into the at least one hollow space; and wherein the plurality of stiffening ribs extend in a circumferential direction of the rotation axis and project towards the interior into the at least one hollow space; or wherein the at least one hollow space includes a plurality of hollows spaces defined by the plurality of stiffening ribs extending in an axial direction of the rotation axis, and wherein the plurality of hollow spaces define a plurality of axially extending bores disposed in the interior of the at least one bearing bush.

13. The supercharging device according to claim 12, wherein the plurality of stiffening ribs delimit the plurality of axially extending bores, and wherein the plurality of axially extending bores are arranged parallel to one another and distributed symmetrically in the interior with respect to the rotation axis of the rotor.

14. The supercharging device according to claim 12, wherein the plurality of stiffening ribs extend in the circumferential direction and have an annular shape.

15. The supercharging device according to claim 12, wherein the rotor further includes a sealing disc disposed between the compressor wheel and the turbine wheel, wherein the sealing disc is coupled on one end to the first face end of the compressor wheel and on another end to the second face end of the turbine wheel.

16. A rotor for a supercharging device, comprising:

a compressor wheel having a first face end and a first longitudinal end;

a turbine wheel operatively coupled to the compressor wheel, the turbine wheel having a second face end and a second longitudinal end, the second face end of the turbine wheel facing towards the first face end of the compressor wheel;

a sealing disc disposed between the compressor wheel and the turbine wheel, wherein the sealing disc is coupled on one end to the first face end of the compressor wheel and on another end to the second face end of the turbine wheel; and at least one bearing bush disposed on at least one of the first longitudinal end of the compressor wheel and the second longitudinal end of the turbine wheel, the at least one bearing bush including a face wall and a circumferential wall defining an interior, the interior including at least one hollow space defined between a plurality of stiffening ribs projecting into the interior, wherein the plurality of stiffening ribs extend at least one of axially and circumferentially along the interior of the at least one bearing bush with respect to an axis of rotation to define the at least one hollow space.

17. The rotor according to claim 16, wherein the compressor wheel, the turbine wheel and the sealing disc respectively include a central recess arranged coaxially to each other; and a central screw arranged in the respectively central recesses securing the compressor wheel, the turbine wheel and the sealing disc to one another.

18. The rotor according to claim 16, wherein the at least one bearing bush is secured to the at least one of the first longitudinal end and the second longitudinal end via a screw connection.

19. The rotor according to claim 18, wherein the screw connection includes an external thread disposed on the at least one bearing bush received in an internal thread disposed on the at least one of the first longitudinal end and the second longitudinal end.

* * * * *